United States Patent [19]

Petro, Jr.

[11] Patent Number: 4,621,187

[45] Date of Patent: Nov. 4, 1986

[54] PAINT SPRAYING AND CURING BOOTH

[76] Inventor: William A. Petro, Jr., 1770 Workman St., Los Angeles, Calif. 90031

[21] Appl. No.: 697,252

[22] Filed: Feb. 1, 1985

[51] Int. Cl.[4] ..... H05B 3/44; F26B 3/30; B05B 12/02

[52] U.S. Cl. ..... 219/358; 34/4; 98/115.2; 118/326; 118/620; 118/642; 219/354; 219/492; 236/46 R; 427/444

[58] Field of Search ..... 219/347-351, 219/354, 478, 483, 492, 493, 400; 34/17, 19, 26, 30, 39, 40, 68, 4, 53, 55; 98/115.2, 115.3, 115.4; 118/326, 641-643, 58, 620; 236/46 R, 46 A, 46 C; 427/444, 55

[56] References Cited

U.S. PATENT DOCUMENTS

| | | | |
|---|---|---|---|
| 1,555,860 | 10/1925 | Ledwinka | 118/620 |
| 1,998,615 | 4/1935 | Groven | 427/55 |
| 2,844,699 | 7/1958 | Miskella | 219/347 |
| 3,211,892 | 10/1965 | Swenson et al. | 219/400 |
| 3,254,421 | 6/1966 | Kielsmeier et al. | 34/53 |
| 3,621,202 | 11/1971 | Gemert | 219/400 |
| 4,136,463 | 1/1979 | Nolan et al. | 118/58 |
| 4,257,172 | 3/1981 | Townsend | 219/377 |
| 4,416,068 | 11/1983 | Nilsson et al. | 219/354 |
| 4,418,271 | 11/1983 | Smock | 219/492 |
| 4,506,144 | 3/1985 | Hesford et al. | 219/349 |
| 4,546,553 | 10/1985 | Best | 34/68 |

FOREIGN PATENT DOCUMENTS

| | | | |
|---|---|---|---|
| 1083898 | 8/1980 | Canada | 427/55 |
| 6017 | 12/1979 | European Pat. Off. | 118/326 |
| 2932392 | 2/1981 | Fed. Rep. of Germany . | |
| 2932616 | 2/1981 | Fed. Rep. of Germany | 118/58 |
| 2347624 | 11/1977 | France | 98/115.2 |
| 2007833 | 5/1979 | United Kingdom | 118/326 |
| 995889 | 2/1983 | U.S.S.R. | 118/58 |

OTHER PUBLICATIONS

"Radiation Curing of Organic Coatings" by Guruswamy et al., Metal Finishing, Jul. 1978, pp. 25-30.

*Primary Examiner*—A. D. Pellinen
*Assistant Examiner*—Geoffrey S. Evans
*Attorney, Agent, or Firm*—Christie, Parker & Hale

[57] ABSTRACT

A sheet metal enclosure is used for spray painting automobiles and for heat curing the paint. A fan draws filtered air through the enclosure. An air supply permits spray painting. Quartz tube radiant heaters are mounted flush with the interior walls of the enclosure for heating the painted vehicle. A safety interlock prevents simultaneous enablement of the sprayer and heaters. Further, there is a first time delay before the air supply is enabled to assure that the heaters are cool before spraying paint, and a second time delay before the heaters are energized to permit the fan to exhaust paint fumes before applying heat.

21 Claims, 4 Drawing Figures

36
CONTROL CONTACTOR
37
38
SPRAY MODE
HEAT MODE
39
MAIN EXHAUST FAN
41
MAKE-UP AIR FAN
42
SPRAY TIMER
43
44
47
AIR SUPPLY
49
DOOR SENSORS
51
AIR FLOW SENSOR
46
SPRAY AIR SOLENOID VALVE
48
SPRAYER
52
HEAT TIMER
54
56
53
39
MAIN EXHAUST FAN
58
CYCLE TIMER
57
HEATERS
59
AUXILIARY FAN

PAINT SPRAYING AND CURING BOOTH

BACKGROUND OF THE INVENTION

This invention relates to a booth in which an automobile or other article can be spray painted and thereafter heat cured with complete safety and in accordance with governmental and industry codes and regulations.

Large scale spray painting operations for automobiles or the like commonly have elongated subdivided tunnels through which a vehicle is moved for various stages of painting and curing. In an initial portion of the tunnel the vehicle is spray painted using conventional compressed air paint spraying equipment. During spray painting air is drawn past the vehicle for removing overspray and solvent fumes. This air is filtered and may be scrubbed to remove solvents before being discharged.

When the spraying is completed, the vehicle is then moved into another portion of the tunnel where the painted surfaces are heated to around 170° F. for rapidly curing the paint. Although paint may dry to the touch in a reasonable time at ambient temperature, it does not cure to full hardness for a period of forty-eight hours to as much as sixty days, depending on the type of primer, lacquer, enamel or the like that is used. Heat curing on the other hand can usually be achieved in twenty to forty minutes. It is therefore highly desirable to heat cure paint on a broad variety of articles, including automobiles.

The sophistication and expense of a spray painting and curing tunnel precludes its use by many small automotive shops that may paint only two or three or fewer cars per day. Such shops have used a variety of makeshift arrangements for painting and curing automobiles.

It is generally required by regulation that painting be in a booth for minimizing environmental contamination. Even in the absence of regulation, painting booths are commonly used so that filtered air passes over the vehicle to minimize imperfections due to dust. After painting, the vehicle may be moved to another area where banks of heat lamps or quartz tube infrared heaters are arrayed for heating the vehicle. Such arrangements make it difficult to obtain uniform heating and may require substantial space.

In other shops portable heat lamps or the like are moved into the spray paint booth after spraying is completed and the vehicle is cured in the booth. Again, uniformity of heating is difficult and subject to the skill of the operator placing the heaters. In either of these arrangements there is the possibility of damaging the uncured paint as the vehicle or heaters are moved.

There has not previously been any booth having permanently installed heaters in which spray painting operations could also be conducted. Because of the high flammability of paint fumes, permanently installed heaters have been impractical for safety reasons. Heating cannot commence until paint fumes are safely removed. Further, it has not been feasible to place heaters in the spray booth during spraying since accumulations of overspray on such heaters can also be a substantial safety hazard.

It is therefore desirable to provide a booth in which vehicles or the like can be spray painted and thereafter cured in the same booth with permanently installed heaters without introducing flammability safety problems.

BRIEF SUMMARY OF THE INVENTION

There is, therefore, provided in practice of this invention according to a presently preferred embodiment, a combined painting and curing booth in the form of an enclosure with a fan for exhausting paint fumes from the enclosure. There is an air supply within the enclosure for spray painting. A number of electric heaters are mounted flush with the interior walls of the enclosure for radiant heating of the articles painted. Such a booth is feasible because of a safety interlock system between the fan, air supply and heaters. The safety interlock system enables either the heaters or the air supply only alternatively and not simultaneously. Further, there is a first time delay for enabling the fan and disabling the heaters for a selected time interval after the air supply is turned off. There is a second time delay for disabling the air supply for a selected time interval after the heaters are turned off. Thus, one cannot spray while the heaters are hot, nor turn on the heaters until paint fumes are safely exhausted.

BRIEF DESCRIPTION OF THE DRAWINGS

These and other features and advantages of the present invention will be appreciated as the same becomes better understood by reference to the following detailed description when considered in connection with the accompanying drawings wherein.

DESCRIPTION

Figure 1:
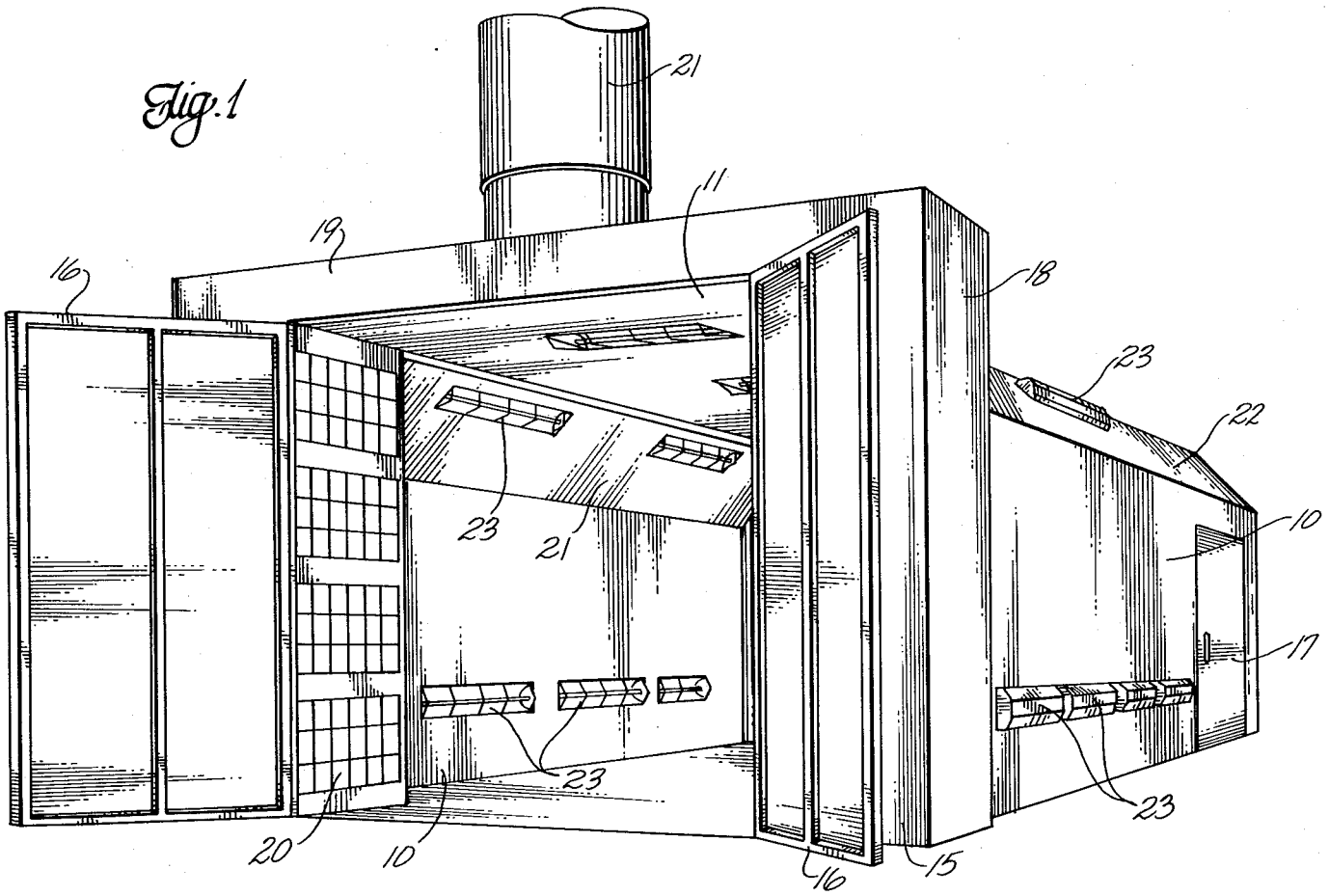
FIG. 1 illustrates in perspective a combined painting and curing booth constructed according to principles of this invention.

The combined painting and spraying booth comprises an uninsulated sheet steel enclosure having vertical side walls 10 and a flat roof 11. Sloping side panels 12 extend between the side walls and the roof somewhat like a gambrel roof. One end wall 13 of the booth has a center portion extending most of the height of the booth with openings in which inlet air filters 14 are placed. This permits dust-free air to enter the booth through the central portion of one end wall. The opposite end wall 15 of the booth has large double doors 16 which can be opened to move in an article, such as an automobile, for painting. Preferably, a pedestrian door 17 is also provided in a side wall.

A U-shaped exhaust plenum is provided at the opposite end of the booth from the inlet filters. The U-shaped plenum has a vertical leg portion 18 on each side of the double doors 16. The two vertical portions of the plenum are interconnected by a horizontal bight portion 19 of the plenum over the top of the double doors. A tube axial exhaust fan 21 is mounted above the horizontal section of the plenum for withdrawing air. In an exemplary embodiment a two horsepower fan may draw up to 14,000 CFM air through the booth.

Tacky filters 20 are provided in the walls of the vertical members of the plenum for removing overspray particles from the air stream before it is discharged. If desired, the exhaust fan can be connected to a fume scrubber for removing solvent vapors. A compressed air supply 22 with a pressure regulator (not shown) connected to an external air compressor (not shown) is provided inside the enclosure for ready access by a person painting the articles therein.

When a vehicle is being painted, it is important to maintain a laminar flow of air past the sides and top of the vehicle for removing overspray. Preferably air flows past one or both ends of the vehicle as well. The flow of filtered air prevents the overspray from depositing on the vehicle or on other objects inside the booth. This is accomplished in the booth provided in practice of this invention by introducing air in a center portion of one end wall and withdrawing air at the side edges of the opposite wall. This assures that there is adequate air flow at one end of the vehicle for diverting overspray away from the end of the vehicle and along the sides of the booth. At the opposite end overspray is drawn towards the sides of the booth. Along the sides and top of the vehicle there is laminar air flow for carrying overspray toward the tacky filters at the side edges of the enclosure. The laminar air flow along the sides and top of a vehicle being sprayed helps prevent overspray from reaching radiant heaters mounted in the walls and roof of the enclosure.

A plurality of quartz tube radiant heaters are mounted flush with the interior walls of the enclosure for heating an automobile or other article after painting. In an exemplary embodiment four such heaters 23 are mounted in each side wall 10 of the enclosure. The center two of these may be 3000 watt heaters and the outer two about 2000 watt heaters. A pair of 3000 watt heaters are mounted in each diagonal side panel 12 and three 3000 watt heaters are mounted in the roof 11. Typically arrangements are made for energizing such heaters in zones so that all or a fraction of such heaters can be used, as appropriate for the desired heating.

Figure 3:
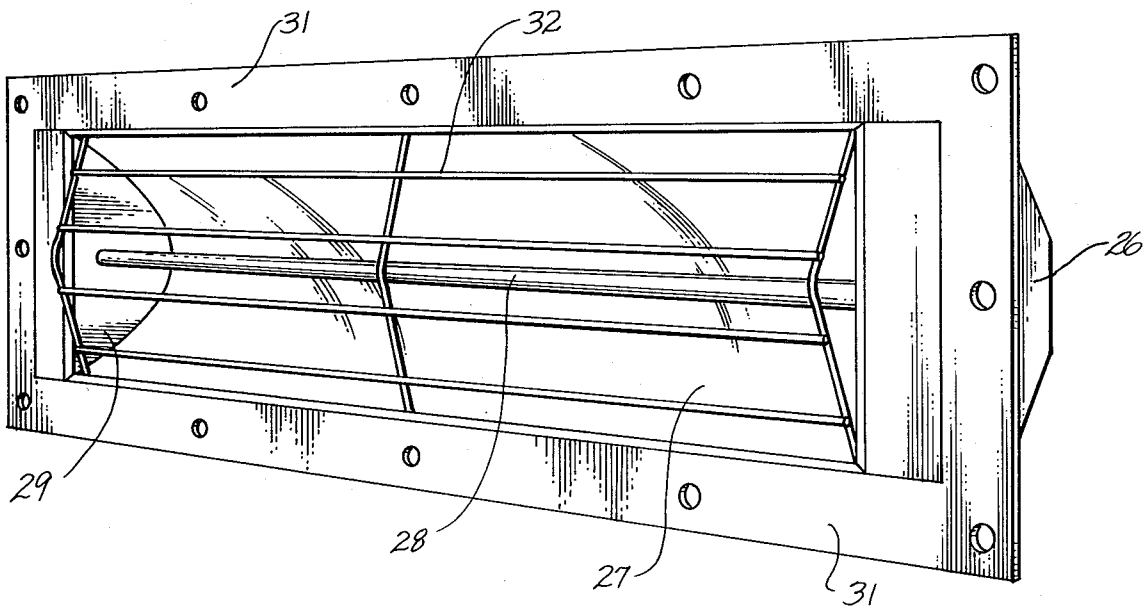
FIG. 3 is a perspective view of a quartz tube radiant heater for such a combined painting and curing booth.

An exemplary quartz tube radiant heater is illustrated in FIG. 3. Each heater has a generally rectangular sheet steel housing 26, that is open on one side and closed on its other sides. A curved polished stainless steel reflector 27 is mounted in the housing with its concave face toward the open side of the housing. A conventional quartz tube radiant heater element 28 extends along the length of the housing in the concave side of the reflector. Such a heater element is in the form of a quartz tube containing a coil of high temperature resistance wire such as Nichrome. Electrical leads are provided at each end for passing a current through the Nichrome wire and heating it to incandescent temperatures for emission of optimum wave lengths of infrared radiation. A flat, roughly semi-circular polished stainless steel radiation shield 29 is mounted diagonally near each end of the quartz tube for minimizing radiation toward the end electrical leads and for reflecting radiation toward objects to be heated. A stainless steel wire grid 32 is mounted in the open face of the housing in front of the heater element to avoid inadvertent contact with or damage to the quartz tube.

In the preferred embodiment a flat sheet metal flange 31 is provided flush with the open face of the housing 26 of the heater. The perforated flange is provided on the open face of the housing for bolting the heater to the sheet metal walls or roof of the enclosure. To mount such a heater, a rectangular hole is cut through the sheet metal of the enclosure. The heater is inserted so that the flange is against the interior of the sheet metal wall where it is bolted in place. This places the housing of the heater outside the enclosure so that the interior of the booth is free of horizontal surfaces on which overspray might collect. Even if there were not a safety hazard from such overspray, inadvertent dislodging of it during spraying could leave unsatisfactory blemishes in the article being painted.

By providing a housing with a flange at its open face, the same heater assembly can be used for construction of new combined painting and curing booths, and for retrofitting existing paint spraying booths to be suitable for practice of this invention. In the case of retrofitting, a rectangular hole can be cut through the sheet metal wall of an existing paint spray booth and a heater assembly as illustrated in FIG. 3 inserted. The flange at the open face of the housing not only provides a means for mounting the heater assembly but also serves to mask the rather imperfect hole most likely encountered in field retrofitting of a painting booth.

Figure 4:
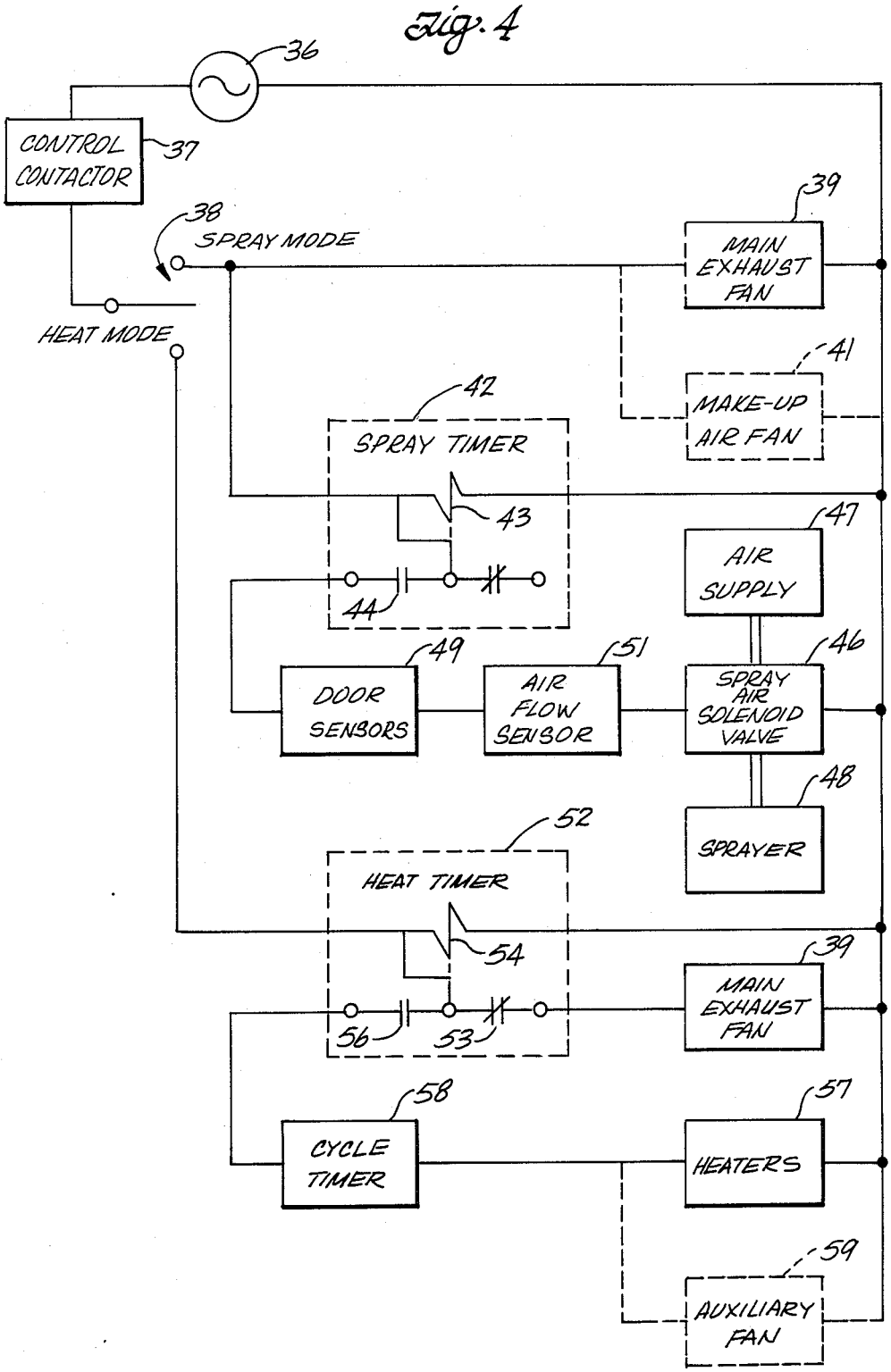
FIG. 4 is a block diagram of a safety interlock system for a combined painting and curing booth.

Since it is important to avoid energizing the heaters while paint fumes are present, a safety interlock system is provided in practice of this invention. Such an interlock system is illustrated schematically in FIG. 4. To illustrate principles of the safety interlock, the system is illustrated as if connected to a single phase public utility power system 36. It will be apparent that the system can readily be connected in a three phase power system, which is preferred for the substantial power loads drawn by the heaters. Power to the system is controlled by a conventional contactor 37, which may be a manual swith or a relay.

The operator has a choice of switching between a spray mode or heat mode of operation by means of a double throw switch 38. By using a double throw switch one may use the booth either for spraying or heating but not both simultaneously. This positive switching between the two separate modes prevents inadvertent enabling of both the heaters and spray air supply which could be a safety hazard. If desired, the switch can have a center position where neither the spray or heat mode is enabled.

Figure 2:
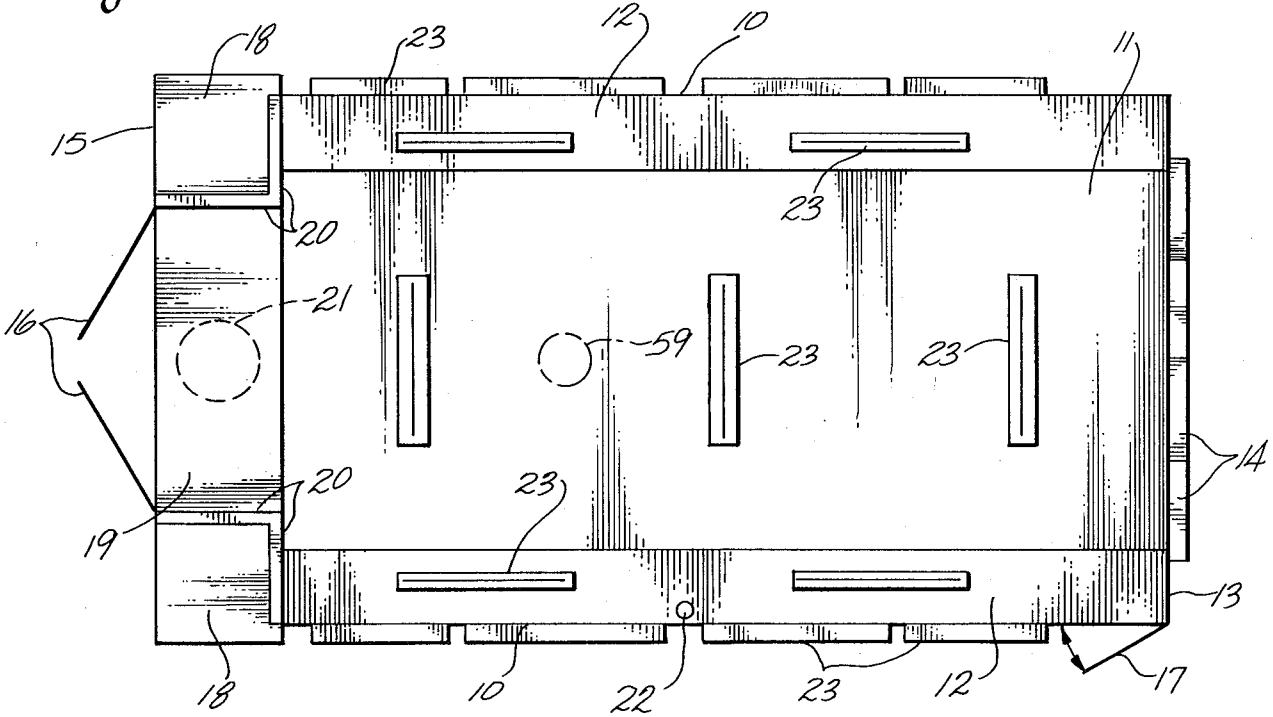
FIG. 2 is a horizontal cross section of such a booth looking upwardly.

When the system is switched to the spray mode, the main exhaust fan 39 (e.g., fan 21 in FIGS. 1 and 2) is enabled for withdrawing air from the plenum at one end of the booth. If desired, a makeup air fan 41 can be used on the inlet end of the booth as well. Such an optional arrangement may be used, for example, where the inlet air is preheated in cold weather.

Switching to the spray mode also enables a spray timer 42. The spray timer has a selected time interval after enablement before a solenoid switch 43 is activated. Activation of the solenoid switch closes a normally open contact 44 which applies power to a solenoid valve 46 which is connected to the supply 47 of compressed air for the sprayer 48 in the booth. The solenoid valve is normally closed so that there is no compressed air in the booth, thereby preventing spraying. When activated at the end of the delay time interval, the solenoid valve opens so that paint spraying can commence.

The solenoid valve is also connected to door sensors 49 which are simple contact switches to assure that the booth doors are closed during spraying. The solenoid valve is also connected to an air flow sensor 51 in the exhaust system to assure that there is no spraying of paint unless there is air flowing through the booth.

When the spraying has been completed, the operator switches from the spray mode to the heat mode. Leaving the spray mode immediately disables the solenoid air valve to prevent spraying. Switching to the heat mode applies power to a heat timer 52, starting its time cycle. This also applies power to the main exhaust fan 39 by way of a normally closed contact 53 in the heat timer. It will be understood that although the main exhaust fan 39 is illustrated twice in the schematic diagram of FIG. 4 this is merely a matter of convenience in illustration and there is but a single exhaust fan that is enabled in both the spray mode and heat mode.

The heat timer 52 has a solenoid switch 54 which operates both the normally closed contact 53 and a normally open contact 56. When the timer has completed its preset delay period, the normally closed contact 53 is opened and the normally open contact 56 is closed. This shuts down the main exhaust fan and applies power to the quartz tube radiant heaters 57 in the spraying and curing booth. Power to the heaters is applied by way of a conventional cycle timer 58 which allows the operator to preset a time interval for heating. For example, the operator may desire to apply heat for curing paint for a period of one hour. In such a case he would set the cycle timer for one hour and at the end of that period after enablement of the heaters, the heater would be shut down. If desired, an auxiliary fan 59 can also be operated during the curing cycle for removing any paint fumes evolved as the paint cures. Such an optional auxiliary fan can be much smaller than the main exhaust fan.

When the safety interlock system is used, it not only prevents simultaneous enabling of the heaters and spray air, but it also provides a time delay between enablement of the spray air and heaters for an additional margin of safety. Thus, when the operator switches to the spray mode, the spray timer provides a delay interval, typically set at about three minutes before the solenoid air valve can be opened. This delay interval assures that if the heaters are hot, there is an adequate time for the heaters to cool below a hazardous temperature before the operator can possibly do any spraying in the booth.

Similarly, when the operator switches from the spray mode to the heat mode, there is a time delay of a few minutes before the heaters are enabled. During this period the main exhaust fan operates to assure that any paint fumes within the enclosure have been exhausted before the heaters are energized. This prevents inadvertent ignition of residual fumes in the booth by premature activation of the heaters.

It will be apparent that many modifications and variations can be made in a combined painting and curing booth without departing from principles of this invention. For example, if desired, an air flow sensor can be connected in series with the solenoid switch 54 on the heat timer to assure that the main exhaust fan is operating during the time delay before the heaters are energized. Various circuit breakers to prevent overloads can be provided for various components of the control system and there can be signal lights for indicating the status of the system.

If desired, the inlet filters 14 can be mounted on double doors that can be opened for admitting a vehicle or other article to be painted from either end of the enclosure. Various patterns of radiant heaters can be provided in the enclosure for obtaining uniform heat distribution for selected articles to be painted. It will also be apparent that fluorescent lights can be mounted in the walls of the enclosure for illuminating the object to be painted. Many other additions, modifications and variations will be apparent to one skilled in the art and it is therefore to be understood that within the scope of the appended claims this invention may be practiced otherwise than as specifically described.

What is claimed is:

1. A combined painting and curing booth comprising:
- a sheet metal enclosure for accommodating a vehicle to be painted;
- means for introducing clean air into one portion of the enclosure;
- means for withdrawing air from another portion of the enclosure;
- means for supplying pressurized air inside the enclosure for spray painting;
- a plurality of quartz tube radiant heater assemblies mounted in the sheet metal walls of the enclosure, each of the heater assemblies being mounted primarily external to the walls so that no substantial portion of the heater assembly extends into the enclosure; and
- means for preventing simultaneous enabling of the air supply means and the heaters.

2. A combined painting and curing booth as recited in claim 1 further comprising means for preventing enablement of the heaters within a first selected time interval of disablement of the air supply means and means for preventing enablement of the air supply means within a second selected time interval of disablement of the heaters.

3. A combined painting and curing booth as recited in claim 1 wherein the means for introducing air is through a center portion of one end of the enclosure and the means for withdrawing air is through side edges at the opposite end of the enclosure.

4. A combined painting and curing booth as recited in claim 1 further comprising means for providing a delay interval between disabling the air supply means and enabling the heaters.

5. A combined painting and curing booth as recited in claim 4 further comprising means for withdrawing air from the enclosure during the delay interval.

6. A combined painting and curing booth as recited in claim 1 further comprising means for providing a delay interval between disabling the heaters and enabling the air supply means.

7. A combined painting and curing booth comprising:
- a sheet metal enclosure for accommodating a vehicle to be painted;
- means for introducing clean air at one end of the enclosure;
- means for withdrawing air from the other end of the enclosure;
- means for supplying pressurized air inside the enclosure for spray painting;
- a plurality of quartz tube radiant heater assemblies mounted in the sheet metal walls of the enclosure, each of the heater assemblies being mounted primarily external to the walls so that no substantial portion of the heater assembly extends into the enclosure;
- means for preventing simultaneous enabling of the air supply means and the heaters;
- means for providing a delay interval between disabling the air supply means and enabling the heaters; and
- means for providing a second delay interval between disabling the heaters and enabling the air supply means.

8. A combined painting and curing booth comprising:
- an enclosure;

an air supply within the enclosure for spray painting;
a fan for exhausting paint fumes from the enclosure;
a plurality of electric heaters flush with the interior walls of the enclosure for radiant heating of a painted article; and
a safety interlock system between the fan, air supply and heaters comprising:
means for enabling the heaters and air supply only alternatively and not simultaneously;
a first time delay circuit for disabling the air supply for a selected time interval before the air supply is activated; and
a second time delay circuit for enabling the fan and disabling the heaters for a selected time interval before the heaters are energized.

9. A combined painting and curing booth as recited in claim 8 wherein the first time delay circuit comprises a normally open solenoid switch, a timer connected to the switch for closing the switch at the end of a first time interval and a solenoid valve connected to the normally open switch.

10. A combined painting and curing booth as recited in claim 9 wherein the second time delay circuit comprises a normally open solenoid switch, a timer connected to the switch for closing the switch at the end of a second time interval and means for connecting the switch to the heaters.

11. A combined painting and curing booth as recited in claim 10 wherein the second time delay circuit also comprises a normally closed contact on the switch and means for connecting the normally closed contact to the fan.

12. A combined painting and curing booth as recited in claim 8 wherein the second time delay circuit comprises a normally open solenoid switch, a timer connected to the switch for closing the switch at the end of a time interval and means for connecting the switch to the heaters.

13. A combined painting and curing booth as recited in claim 12 wherein the second time delay circuit also comprises a normally closed contact on the switch and means for connecting the normally closed contact to the fan.

14. A safety interlock system for a combined painting and curing booth having a fan for passing air through the booth for exhausting paint fumes and electric heaters for curing a painted article comprising:
a double throw switch for alternatively enabling a spraying mode of operation of the booth or enabling a heating mode of operation of the booth, and preventing simultaneous enablement of both the spraying and heating modes;
means for enabling a fan for passing air through the booth during the spraying mode;
a first time delay means for providing a first time interval between switching to the spraying mode and enablement of a supply of pressurized spraying air in the booth; and
a second time delay means for providing a second time interval between switching to the heating mode and enablement of electric heaters in the booth.

15. A safety interlock system as recited in claim 14 further comprising means for enabling the fan during the second time interval.

16. A safety interlock system as recited in claim 14 wherein the first time delay means comprises a normally open solenoid switch, a timer connected to the switch for closing the switch at the end of the first time interval and a solenoid valve connected to the normally open switch.

17. A safety interlock system as recited in claim 16 further comprising means for enabling the fan for the booth when switched to the spraying mode.

18. A safety interlock system as recited in claim 16 wherein the second time delay means comprises a normally open solenoid switch, a timer connected to the switch for closing the switch at the end of the second time interval and means for connecting the switch to heaters in the booth.

19. A safety interlock system as recited in claim 18 wherein the second time delay means also comprises a normally closed contact on the switch and means for connecting the normally closed contact to the fan for the booth.

20. A safety interlock system as recited in claim 14 wherein the second time delay means comprises a normally open solenoid switch, a timer connected to the switch for closing the switch at the end of the second time interval and means for connecting the switch to heaters in the booth.

21. A combined painting and curing booth comprising:
a sheet metal enclosure for accommodating a vehicle to be painted;
means for introducing clean air at one end of the enclosure;
means for withdrawing air from the other end of the enclsoure;
means for supplying pressurized air inside the enclosure for spray painting;
a plurality of quartz tube radiant heater assemblies mounted in the sheet metal walls of the enclosure, each of the heater assemblies being mounted primarily external to the walls so that no substantial portion of the heater assembly extends into the enclosure;
means for preventing simultaneous enabling of the air supply means and the heaters;
means for providing a first delay interval between disabling the air supply means and enabling the heaters;
means for withdrawing air from the enclosure during the first delay interval; and
means for providing a second delay interval between disabling the heaters and enabling the air supply means.

* * * * *